US005498393A

United States Patent [19]

Horimura et al.

[11] Patent Number: 5,498,393

[45] Date of Patent: Mar. 12, 1996

[54] POWDER FORGING METHOD OF ALUMINUM ALLOY POWDER HAVING HIGH PROOF STRESS AND TOUGHNESS

[75] Inventors: Hiroyuki Horimura; Kenji Okamoto; Masahiko Minemi, all of Saitama; Toshihiko Kaji, Hyogo; Yoshishige Takano, Hyogo; Yoshinobu Takeda, Hyogo, all of Japan

[73] Assignees: Honda Giken Kogyo Kabushikikaisha, Tokyo; Sumitomo Electric Industries, Ltd., Osaka, both of Japan

[21] Appl. No.: 280,386

[22] Filed: Jul. 26, 1994

[30] Foreign Application Priority Data

Aug. 9, 1993 [JP] Japan ..... 5-197553

[51] Int. Cl.[6] ..... B22F 3/17

[52] U.S. Cl. ..... 419/28; 419/32; 419/33; 419/38; 419/47; 419/48

[58] Field of Search ..... 419/28, 32, 33, 419/38, 47, 48

[56] References Cited

U.S. PATENT DOCUMENTS 5,312,494 5/1994 Horimura et al. ..... 148/437

FOREIGN PATENT DOCUMENTS 0218035 4/1987 European Pat. Off. .
WO-8909839 10/1989 European Pat. Off. .
0339676 11/1989 European Pat. Off. .
2-274834 11/1990 Japan .
5-279767 10/1993 Japan .
WO93/09899 5/1993 WIPO .

OTHER PUBLICATIONS

"Ultrahigh Mechanical Strengths of $Al_{88}Y_2Ni_{10-x}M_x$ (M=Mn, Fe or Co) Amorphous Alloy . . . " by Kim et al., Materials Transactions, JIM, vol. 32, No. 7(1991). pp. 599 to 608.

"Mechanical properties of $Al_{88}(Y_{1-x}Ce_x)_2Ni_9Fe_1$(x=0, 0.5, 1) amorphous alloys . . . " by Kim et al., Research Report, vol. 42, No. 4, pp. 217 to 223.

*Primary Examiner*—Donald P. Walsh
*Assistant Examiner*—Scott T. Bluni

[57] ABSTRACT

An aluminum alloy powder or a green compact thereof is prepared, wherein: (1) the composition formula is $Al_{100-a-b}Fe_aX_b$ where a and b in atomic % are $4.0 \leqq a \leqq 6.0$, $1.0 \leqq b \leqq 4.0$, and where X is at least one alloy element selected from Y and Mm (mish metal); or (2) the composition formula is $Al_{100-a-b-c}Fe_aSi_bX_c$, where a, b and c in atomic % are $3.0 \leqq a \leqq 6.0$, $0.5 \leqq b \leqq 3.0$, and $0.5 \leqq c \leqq 3.0$, and where X is at least one alloy element selected from Ti, Co, Ni, Mn and Cr, and wherein both (1) and (2) include an amorphous phase of at least 1% by volume. The aluminum alloy powder or the green compact thereof is heated at a temperature increasing at a rate of at least 80° C./min. to a predetermined temperature of at least 560° C. and not more than a temperature at which 10% by volume of a liquid phase is contained in the alloy powder or green compact. The aluminum alloy powder or the green compact thereof is powder forged at the predetermined temperature. As a result, an aluminum alloy superior in static strength and dynamic strength can be produced.

24 Claims, No Drawings

POWDER FORGING METHOD OF ALUMINUM ALLOY POWDER HAVING HIGH PROOF STRESS AND TOUGHNESS

BACKGROUND OF THE INVENTION

1. Field of the Invention

The present invention relates to a powder forging method for producing aluminum (Al) alloy powder of high proof stress and toughness that can be used for components such as engine components of cars in which toughness is required. More particularly, the present invention relates to a powder forging method for producing an aluminum alloy superior in dynamic strength.

2. Description of the Background Art

A method of powder forging by subjecting an amorphous phase to a heat treatment is disclosed in Japanese Patent Application No. 4-77650 (filed Mar. 31, 1992) (Japanese Patent Laying-Open No. 5-279767) by the inventors of the present application.

A method of heating atomized powder of Al-Fe-Y type to obtain aluminum in a nano structure (a structure of grains or precipitates in nm units) is disclosed in Japanese Patent Laying-Open No. 2-274834.

Atomized powder of Al-Fe-Si-X type (where X is at least one of Ti, Co, Ni, Mn, and Cr) is disclosed in Japanese Patent Application No. 4-113712 (filed May 6, 1992) and corresponding U.S. Pat. No. 5,312,494 by the inventors of the present application.

The above-mentioned Japanese Patent Laying-Open No. 5-279767 and corresponding Application 4-77650 proposing a powder forging method only describes the forging temperature to be "at least the glass transition temperature" (approximately 250°–300° C. in general). The highest temperature described in the embodiment thereof is 550° C. The inventors of the present application carried out various experiments according to that description, and determined that a heating process up to the temperature of 550° C. can be used to achieve favorable values for static strength by a tensile test or the like, but not for dynamic strength represented by Charpy impact values for example.

The alloy disclosed in the above-mentioned Japanese Patent Laying-Open No. 2-274834 and Japanese Patent Application No. 4-113712 is noteworthy of having superior static strength and dynamic strength. However, the strength of that disclosed alloy has been assessed only for an alloy that is solidified by extrusion. The inventors of the present application have determined that the static strength is superior, but the dynamic strength of that disclosed alloy is not sufficient when this alloy is powder-forged at the general heating temperature of 450°–550° C.

A powder forging method of producing an aluminum alloy that satisfies both the static strength and the dynamic strength has not yet been achieved.

SUMMARY OF THE INVENTION

An object of the present invention is to provide a powder forging method of producing an aluminum alloy having superior static strength and dynamic strength.

In view of the foregoing, the present inventors have made intensive research efforts to obtain an aluminum alloy having superior static strength and dynamic strength by a forging method with the present predetermined alloy composition including aluminum. The present method is characterized in that forging is carried out after the forging temperature is rapidly raised to a high temperature level.

According to a first aspect or embodiment of the present invention, a powder forging method of aluminum alloy powder having high proof stress and high toughness includes the following steps. At least either an aluminum alloy powder or a green compact thereof is prepared, wherein the general formula of the composition is:

$Al_{100-a-b}Fe_aX_b$ where a and b in atomic % are in the ranges:

$4.0 \leqq a \leqq 6.0$, $1.0 \leqq b \leqq 4.0$, and where X is at least one alloy element selected from Y (yttrium) and Mm (mish metal), and wherein at least 1% by volume of an amorphous phase is contained in at least either the aluminum alloy powder or the green compact thereof. At least either the aluminum alloy powder or the green compact is heated at a temperature that increases at a rate of at least 80° C. per minute to a predetermined temperature of at least 560° C. and not more than a temperature at which 10% by volume of a liquid phase is contained in the powder or compact. At least either the aluminum alloy powder or the green compact is powder-forged at that predetermined temperature.

In a powder forging method according to a preferable aspect of the present invention, the predetermined temperature is at least 600° C. and not more than a temperature at which 10% by volume of a liquid phase is contained in the powder or the green compact.

According to a second aspect of the present invention, a powder forging method includes the following steps. At least either an aluminum alloy powder or a green compact thereof is prepared, wherein the general formula of the composition is:

$Al_{100-a-b-c}Fe_aSi_bX_c$ wherein a, b, and c in atomic % are in the ranges:

$3.0 \leqq a \leqq 6.0$, $0.5 \leqq b \leqq 3.0$, $0.5 \leqq c \leqq 3.0$, and where X is at least one alloy element selected from Ti (titanium), Co (cobalt), Ni (nickel), Mn (manganese) and Cr (Chromium), and wherein at least 1% by volume of an amorphous phase is contained in the powder or the green compact. At least either the aluminum alloy powder or the green compact thereof is heated at a temperature increasing at a rate of at least 80° C. per minute to a predetermined temperature of at least 560° C. and not more than a temperature at which 10% by volume of a liquid phase is contained in the powder or compact. At least either the aluminum alloy powder or the green compact thereof is powder-forged at that predetermined temperature.

According to a preferable method according to the invention the predetermined temperature is at least 580° C. and not more than a temperature at which 10% by volume of a liquid phase is contained in the powder or green compact.

The present invention is characterized in that a high static strength of a powder forged product can be maintained and the dynamic strength thereof can be improved when using the above-described alloy composition. More specifically, the present invention is characterized in that forging is carried out with the powder rapidly heated to a high forging temperature, which has not been used in a conventional powder forging method. As a result of the present inventive method, it is possible to improve the bonding of the powder in powder-forging.

In a conventional alloy, a liquid phase becomes distinguishable beginning at a temperature of approximately 530°

C. In such a conventional alloy, forging is carried out at a temperature of approximately 490°–520° C.

A powder forging method differs from an extrusion method in that a great shear force is not exerted upon the powder in powder forging. Therefore, an oxide coating ($Al_2O_3$) that may exist on the surface of a powder particle and prevents the bonding of powder particles with each other cannot be fractured and disrupted by such a shear force in the powder forging method.

Conventionally-used air atomized powder particles have a surface oxide film generated in the liquid phase at high temperature, and the eventual configuration of the particle becomes distorted and uneven due to heat shrinkage between the internal metal and the surface oxide coating. Therefore, the oxide coating of air atomized powder particles is easily fractured and disrupted as a result of great local shearing deformation caused by a simple compression deformation of the particles.

Hard particles such as intermetallic compounds of Si (silicon) or Fe (iron) and Al (aluminum) of approximately 1–5 μm are dispersed in the material powder used for conventional powder forging. These hard particles serve to fracture and disrupt the surface coating of the particles at the time of the deformation caused by the powder forging.

It is often not possible to obtain sufficient bonding between powder particles by powder forging the above-described amorphous powder used in the present application or the aluminum powder of high proof stress and high toughness including an amorphous phase of at least 1% by volume. This lack of sufficient bonding can be explained for four reasons. First, the powder particles have a sphere-like configuration due to being solidified rapidly in an inert gas, so that a great local deformation does not occur with a simple compression. Second, the powder particles are not easily deformed during powder forging due to their hyperfine structure that is amorphous or nearly amorphous with high strength. Third, a great local deformation does not occur during deformation since the structure is hyperfine and uniform. Fourth, the volumetric shrinking of the amorphous phase that occurs during crystallization due to heating prevents the destruction of the surface oxide coating that is caused by thermal expansion of the internal metal during a heating step prior to forging.

In forming an amorphous phase by a molten metal rapid cooling method such as high pressure gas atomization or a solid phase reaction method such as mechanical alloying, an alloy element is used for improving the amorphous phase formation performance. This alloy element is known to have the features such as: (a) the atomic dimension ratio relative to aluminum, which forms a matrix, is not more than 0.8; and (b) the interatomic interaction with aluminum is negative, and the mixing enthalpy is high. All alloy elements exhibiting the first mentioned features (a) and (b) cannot easily form a solid solution with the aluminum matrix, and have a low migration. Such alloy elements function to raise rather than lower the melting point of an aluminum alloy. Because an aluminum alloy including such an alloy element will not fuse even when heated to a high temperature, and because the structure is not easily roughened, forging at a higher temperature is possible.

A forging process at a higher temperature offers the following effects. As a first effect the water of crystallization of the surface oxide coating is more completely removed, so that the coating becomes brittle. A general surface structure of an aluminum alloy is set forth in the following. There is a crystalline alumina called γ alumina at the surface of an aluminum base. An alumina layer including water of crystallization exists at the surface of the crystalline alumina. On the surface of the alumina layer, water of absorption is present. Although alumina including water of crystallization has a certain degree of ductility, this ductility is lost when the water of crystallization is removed by heat degassing, so that a slight deformation will cause fracture. As a second effect (ii), an increase in the range of the heating temperature increases the difference in the thermal expansion between the oxide coating and the internal metal, whereby fracture and disruption of the coating becomes significant. As a third effect (iii), a heating process to a higher temperature facilitates the softening and deformation of the powder particles.

Depending upon the composition, the forging temperature at which the above-described effects (i), (ii), and (iii) are achieved is at least 560° C., preferably at least 600° C., with the composition of the first aspect of the present invention. Furthermore, the above effects cannot be easily obtained unless the forging temperature is at least 560° C., preferably at least 580° C. with the composition according to the second aspect of the present invention.

Thus, the material powder that is used in the present invention and that includes amorphous promoting elements such as the Fe, X composition described above or the Fe, Si, X composition can be powder forged at a temperature of at least 560° C. Because powder forging can be carried out at the above-described temperature, the above described effects (i), (ii) and (iii) can be easily obtained.

The upper limit of the forging temperature is arbitrary as long as the volume ratio of the liquid phase is not more than 10% by volume. Although the presence of some liquid phase promotes sintering, a liquid phase content of more than 10% by volume will lead to the disadvantage of the melted liquid being sputtered out during forging. The volume percentage content of a liquid phase formed during heating can be measured in a conventional manner, for example using a conventional differential scanning calorimeter (DSC). A sample is heated so as to raise the temperature at a particular heating rate of interest. The calorific value is noted using the DSC, at the temperature when dissolution begins and the temperature when dissolution is 100% complete. The temperature can be measured by any suitable known means such as a thermocouple or a radiation thermometer. The amount of liquid phase formed up to any given temperature is proportional to the corresponding change in calorific value, so a graph relating the increase in liquid phase to the increase in calorific value and corresponding temperature can be generated. That graph can be used to determine the liquid phase content of samples to be powder forged after having been heated at the particular heating rate of interest to a particular temperature, which is then simply correlated to a liquid phase content using the graph.

It is to be noted that forging at a higher temperature causes the structure to become rough, whereby the solidified material is reduced in strength. In order to avoid this problem, heating must be carried out rapidly in a short time. Therefore, the rate of increasing the temperature is at least 80° C. per minute. A slower rate will cause roughness of the structure.

The compositions described in the above first and second aspects or embodiments of the present invention are most preferable for effective powder forging with rapid heating at high temperature.

More specifically, although the composition according to the first aspect of the present invention includes expensive alloy constituents such as Y and Mm, it is the best alloy composition in view of mechanical characteristics. The composition according to the second aspect of the present invention is economical because it does not contain expensive element constituents. Furthermore, the composition of the second embodiment has a high amorphous formation ability.

The Fe, X composition (X is at least one component selected from Y and Mm), or the Fe, Si, X composition (X is at least one component selected from Ti, Co, Ni, Mn and Cr) are amorphous promoting elements. Among these elements, Fe or Fe and Si are essential elements wherein the minimum required amorphous performance is obtained by three or more elements including these essential elements together.

It is to be noted that the aluminum powder alloy cannot be easily rendered amorphous if the amount of the above-described elements, i.e. the atomic % of the alloy elements expressed by a and b according to the first aspect of the invention or expressed by a, b and c according to the second aspect of the invention, is below the above-described lower limit. If the atomic % is too high, then the aluminum powder alloy becomes brittle when crystallized.

Although all the material powder does not have to be amorphous, a rough intermetallic compound will be crystallized if the alloy composition does not include any amorphous phase. It is therefore necessary to use material powder that has an amorphous phase of at least 1% by volume. Such a powder will have a certain level of amorphous performance, and the structure will show a complete solid solution or will be hyperfine at the nano level (the level of a structure of crystal grains and precipitates of nm units).

Conventional ambient chamber heating is not appropriate for rapid heating. In order to suppress roughening of the texture due to forging at high temperature, the present invention uses induction heating or resistance heating, which are each an internal heating method, or infrared radiation heating or laser heating, which are each a surface heating method.

The aluminum alloy powder may not only be gas atomized powder, but may be a combination of at least one type of powder selected from the group consisting of comminuted powder of a quenching ribbon, a splat cooling powder, a melt spinning powder, and a mechanical alloy powder.

Mish metal is a mixture of cerium group rare earth elements, and is referred to as a semifinished product of a refining process. Amish metal generally includes 40–50% Ce by weight and 20–40% La by weight. Mish metal is used because of its low cost.

The foregoing and other objects, features, aspects and advantages of the present invention will become more apparent from the following detailed description of the present invention.

DETAILED DESCRIPTION OF THE PREFERRED EMBODIMENTS OF THE INVENTION

An embodiment of the present invention will be described hereinafter. Two compositions (A) and (B) were prepared as follows in atomic %:

(A) $Al\text{-}Fe_5\text{-}Y_3$ (i.e., a composition of 5 atomic % of Fe, 3 atomic % of Y, and the remainder of Al and unavoidable impurities), and (B) $Al\text{-}Fe_{5.5}\text{-}Ti_{1.5}\text{-}Si_2$ (i.e. a composition of 5.5 atomic % of Fe, 1.5 atomic % of Ti, 2 atomic % of Si, and the remainder of Al and unavoidable impurities. These two compositions (A) and (B) were powder forged according to the following procedure. Namely, the materials were each atomized in an inert gas to form a powder. The powder was sieved through a 100 μm sieve. The sieved powder was preformed at a pressure of 4 ton/cm$^2$. Different preformed samples were heated respectively under one of three different heating conditions to different temperatures as shown below. The samples were then forged at 8 ton/cm$^2$. Finally, the values of 0.2% proof stress, elongation after fracture, and the Charpy impact value were examined. The above-mentioned heating was respectively carried out according to one of the following conditions:

(1) Induction heating: temperature increasing at a rate of 100° C./min.

(2) General ambient heating chamber (Ar ambient of −45° C. of dew point: temperature increasing at a rate of 20° C./min.)

(3) Induction heating: temperature increasing at a rate of 50° C./min.

The results are shown in the following Table 1.

TABLE 1

| Composition | Heating method and Rate | Achieved temperature (°C.) | 0.2% Proof stress (kgf/mm$^2$) | Elongation after fracture (%) | Charpy impact value (J/cm$^3$) | Class | Determination |
|---|---|---|---|---|---|---|---|
| A | (1) | 500 | 50 | 0.3 | 9 | Comparative Example | — |
| | | 550 | 65 | 2 | 13 | Comparative Example | — |
| | | 560 | 62 | 6 | 16 | Present Invention | ○ |
| | | 580 | 55 | 9 | 18 | Present Invention | ○ |
| | | 600 | 53 | 15 | 30 | Present Invention | ◎ |
| | | 650 | 49 | 20 | 35 | Present Invention | ◎ |
| | (2) | 500 | 53 | 0.0 | 2 | Comparative Example | — |
| | | 550 | 58 | 0.3 | 3 | Comparative Example | — |
| | | 600 | 49 | 1 | 10 | Comparative Example | — |
| | | 650 | 42 | 2.5 | 15 | Comparative Example | — |
| B | (1) | 500 | 66 | 0.0 | 4 | Comparative Example | — |
| | | 550 | 60 | 6.3 | 10 | Comparative Example | — |
| | | 560 | 58 | 7.1 | 17 | Present Invention | ○ |
| | | 580 | 55 | 7.5 | 21 | Present Invention | ◎ |
| | | 600 | 52 | 9 | 22 | Present Invention | ◎ |
| | | 630 | 48 | 14 | 29 | Present Invention | ◎ |
| | (2) | 500 | 59 | 0.0 | 3 | Comparative Example | — |
| | | 550 | 57 | 0.2 | 9 | Comparative Example | — |

TABLE 1-continued

| Composition | Heating method and Rate | Achieved temperature (°C.) | 0.2% Proof stress (kgf/mm$^2$) | Elongation after fracture (%) | Charpy impact value (J/cm$^3$) | Class | Determination |
|---|---|---|---|---|---|---|---|
| | | 600 | 48 | 6 | 13 | Comparative Example | — |
| | | 630 | 36 | 15 | 30 | Comparative Example | — |
| | (3) | 600 | 42 | 13 | 28 | Comparative Example | — |
| | | 630 | 40 | 15 | 31 | Comparative Example | — |

Determination conditions:

⊙: 0.2% proof stress is at least 45 kgf/mm$^2$, and elongation after fracture is at least 5%, and Charpy impact value is at least 20 J/cm$^2$ O: 0.2% proof stress is at least 45 kgf/mm$^2$, and elongation after fracture is at least 5%, and Charpy impact value is at least 15 J/cm$^2$ It can be seen from the results reported in Table 1, that an aluminum alloy of high proof stress and high toughness (the Charpy impact value is at least 20 J/cm$^2$) can be obtained by forging solidification according to the powder forging method of the present invention.

Thus, according to the powder forging method of the present invention, an aluminum alloy that is superior in proof stress and toughness can be obtained. The aluminum alloy produced by the powder forging method of the present invention can effectively be used for components of cars and construction members where high proof stress and toughness are required.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A powder forging method for forming an aluminum alloy of high proof stress and high toughness, comprising:

(a) preparing an aluminum alloy powder, wherein the general formula of the composition of said powder is $Al_{100-a-b}Fe_aX_b$, where a and b in atomic % are in the ranges $4.0 \leqq a \leqq 6.0$ and $1.0 \leqq b \leqq 4.0$, and where X is at least one alloy element selected from Y (yttrium) and Mm (mish metal), and wherein said powder contains at least 1% by volume of an amorphous phase;

(b) heating said aluminum alloy powder at a temperature that increases at a rate of at least 80° C. per minute to a predetermined temperature of at least 560° C. and not more than a temperature at which 10% by volume of a liquid phase is present, wherein said heating is carried out until at least some liquid phase is present; and (c) powder forging said aluminum alloy powder at said predetermined temperature to form said aluminum alloy.

2. The powder forging method according to claim 1, wherein said predetermined temperature is at least 600° C.

3. The powder forging method according to claim 1, wherein said heating step (b) includes heating by at least one method selected from the group consisting of induction heating, resistance heating, infrared radiation heating, and laser heating.

4. The powder forging method according to claim 1, wherein said step (a) of preparing said aluminum alloy powder includes forming said powder as at least one type of powder selected from the group consisting of gas atomized powder, comminuted powder of quenching ribbon, splat cooling powder, melt spinning powder and mechanical alloying powder.

5. The powder forging method according to claim 1, further comprising preforming said aluminum alloy powder into a green compact before said heating step (b), wherein said step (b) of heating said aluminum alloy powder and said step (c) of powder forging said aluminum alloy powder are carried out on said green compact.

6. The powder forging method according to claim 5, wherein said preforming step is carried out at a pressure of about 4 ton/cm$^2$.

7. The powder forging method according to claim 1, wherein said powder forging step (c) is carried out at a pressure of about 8 ton/cm$^2$.

8. The powder forging method according to claim 1, further comprising particularly selecting said composition, said rate of temperature increase and said predetermined temperature so that said aluminum alloy has a 0.2% proof stress of at least 45 kgf/mm$^2$, an elongation after fracture of at least 5%, and a Charpy impact value of at least 15 J/cm$^2$.

9. The powder forging method according to claim 1, wherein said general formula of said composition is about $Al_{92}Fe_5Y_3$.

10. The powder forging method according to claim 1, wherein said rate of temperature increase is about 100° C./min.

11. The powder forging method according to claim 1, wherein said predetermined temperature is about 650° C.

12. A powder forging method for forming an aluminum alloy of high proof stress and high toughness, comprising:

(a) preparing an aluminum alloy powder, wherein the general formula of the composition of said powder is $Al_{100-a-b-c}Fe_aSi_bX_c$, where a, b and c in atomic % are in the ranges $3.0 \leqq a \leqq 6.0$, $0.5 \leqq b \leqq 3.0$ and $0.5 \leqq c \leqq 3.0$, and where X is at least one alloy element selected from Ti, Co, Ni, Mn and Cr, and wherein said powder contains at least 1% by volume of an amorphous phase;

(b) heating said aluminum alloy powder at a temperature that increases at a rate of at least 80° C. per minute to a predetermined temperature of at least 560° C. and not more than a temperature at which 10% by volume of a liquid phase is present, wherein said heating is carried out until at least some liquid phase is present; and (c) powder forging said aluminum alloy powder at said predetermined temperature to form said aluminum alloy.

13. The powder forging method according to claim 12, wherein said predetermined temperature is at least 580° C.

14. The powder forging method according to claim 12, wherein said heating step (b) includes heating by at least one method selected from the group consisting of induction heating, resistance heating, infrared radiation heating and laser heating.

15. The powder forging method according to claim 12, wherein said step (a) of preparing said aluminum alloy powder includes forming said powder as at least one type of powder selected from the group consisting of gas atomized powder, comminuted powder of quench ribbon, splat cooling powder, melt spinning powder and mechanical alloying powder.

16. The powder forging method according to claim 12, further comprising preforming said aluminum alloy powder into a green compact before said heating step (b), wherein said step (b) of heating said aluminum alloy powder and said step (c) of powder forging said aluminum alloy powder are carried out on said green compact.

17. The powder forging method according to claim 16, wherein said preforming step is carried out at a pressure of about 4 ton/cm$^2$.

18. The powder forging method according to claim 12, wherein said powder forging step (c) is carried out at a pressure of about 8 ton/cm$^2$.

19. The powder forging method according to claim 12, further comprising particularly selecting said composition, said rate of temperature increase and said predetermined temperature so that said aluminum alloy has a 0.2% proof stress of at least 45 kgf/mm$^2$, an elongation after fraction of at least 5%, and a Charpy impact value of at least 15 J/cm$^2$.

20. The powder forging method according to claim 12, wherein said general formula of said composition is about $Al_{91}Fe_{5.5}Si_2Ti_{1.5}$.

21. The powder forging method according to claim 5, wherein said rate of temperature increase is about 100° C./min.

22. A powder forging method for forming an aluminum alloy of high proof stress and high toughness, comprising:

(a) preparing an aluminum alloy powder, wherein the general formula of the composition of said powder is $Al_{100-a-b}Fe_aX_b$, where a and b in atomic % are in the ranges $4.0 \leqq a \leqq 6.0$ and $1.0 \leqq b \leqq 4.0$, and where X is at least one alloy element selected from Y (yttrium) and Mm (mish metal), and wherein said powder contains at least 1% by volume of an amorphous phase;

(b) heating said aluminum alloy powder at a temperature that increases at a rate of at least 80° C. per minute to a predetermined temperature of about 650° C.; and (c) powder forging said aluminum alloy powder at said predetermined temperature to form said aluminum alloy.

23. A powder forging method for forming an aluminum alloy of high proof stress and high toughness, comprising:

(a) preparing an aluminum alloy powder, wherein the general formula of the composition of said powder is $Al_{100-a-b}Fe_aX_b$, where a and b in atomic % are in the ranges $4.0 \leqq a \leqq 6.0$ and $1.0 \leqq b \leqq 4.0$, and where X is at least one alloy element selected from Y (yttrium) and Mm (mish metal), and wherein said powder contains at least 1% by volume of an amorphous phase;

(b) heating said aluminum alloy powder at a temperature that increases at a rate of at least 80° C. per minute to a predetermined temperature of at least 560° C. and not more than a temperature at which 10% by volume of a liquid phase is present, wherein said predetermined temperature is greater than the melting temperature of the aluminum alloy powder; and (c) powder forging said aluminum alloy powder at said predetermined temperature to form said aluminum alloy.

24. A powder forging method for forming an aluminum alloy of high proof stress and high toughness, comprising:

(a) preparing an aluminum alloy powder, wherein the general formula of the composition of said powder is $Al_{100-a-b-c}Fe_aSi_bX_c$, where a, b and c in atomic % are in the ranges $3.0 \leqq a \leqq 6.0$, $0.5 \leqq b \leqq 3.0$ and $0.5 \leqq c \leqq 3.0$, and where X is at least one alloy element selected from Ti, Co, Ni, Mn and Cr, and wherein said powder contains at least 1% by volume of an amorphous phase;

(b) heating said aluminum alloy powder at a temperature that increases at a rate of at least 80° C. per minute to a predetermined temperature of at least 560° C. and not more than a temperature at which 10% by volume of a liquid phase is present, wherein said predetermined temperature is greater than the melting temperature of the aluminum alloy powder; and (c) powder forging said aluminum alloy powder at said predetermined temperature to form said aluminum alloy.

* * * * *

UNITED STATES PATENT AND TRADEMARK OFFICE

CERTIFICATE OF CORRECTION

PATENT NO. : 5,498,393

DATED : Mar. 12, 1996

INVENTOR(S) : Horimura et al.

It is certified that error appears in the above-identified patent and that said Letters Patent is hereby corrected as shown below:

On the Title Page:
In [56] References Cited, enter the following U. S. Patent Documents:

--4,379,719 4/83 Hildeman et al.
4,435,213 3/84 Hildeman et al.
4,464,199 8/84 Hildeman et al.
4,702,885 10/87 Odani et al.
4,878,967 11/89 Adam et al.
5,000,781 3/91 Skinner et al.
5,344,605 9/94 Kaji et al.--.

Column 1, line 49, after "strength" insert --of that disclosed alloy--;
line 50, delete "of that disclosed alloy";
line 65, delete "a";
line 66, replace "the present" by --a--.
Column 2, line 53, after "tion" insert --,--.
Column 3, line 53, replace "first" by --just--;
line 62, after "effect" insert --(i)--.

Signed and Sealed this

Thirtieth Day of July, 1996

Bruce Lehman

*Attest:*

BRUCE LEHMAN

*Attesting Officer*

*Commissioner of Patents and Trademarks*